United States Patent [19]

Greek, Jr. et al.

[11] 3,968,868

[45] July 13, 1976

[54] FORMAT CONTROL SYSTEM FOR POSITIONING FINAL COPY PRINTED TEXT

[75] Inventors: John Charlie Greek, Jr.; Eric Sigfried Petterson; Howard Carl Tanner, all of Austin; David Wesley Terry, Georgetown, all of Tex.

[73] Assignee: International Business Machines Corporation, Armonk, N.Y.

[22] Filed: Dec. 21, 1973

[21] Appl. No.: 427,184

[52] U.S. Cl. ..... 197/19; 340/172.5

[51] Int. Cl.[2] ..... B41J 5/30

[58] Field of Search ..... 197/19, 20, 84 R, 84 A, 197/187; 199/18; 340/172.5

[56] References Cited

UNITED STATES PATENTS

| | | | |
|---|---|---|---|
| 2,869,717 | 1/1959 | Rossetto et al. | 199/18 |
| 2,910,163 | 10/1959 | Hanson et al. | 197/19 |
| 3,272,306 | 9/1966 | De Witt et al. | 197/20 X |
| 3,529,296 | 9/1970 | Friedman et al. | 197/84 A X |
| 3,610,902 | 10/1971 | Rahenkamp et al. | 340/172.5 X |
| 3,812,945 | 5/1974 | Koplow et al. | 197/19 |
| R25,354 | 3/1963 | Rossetto et al. | 197/19 X |

*Primary Examiner*—Edgar S. Burr

*Attorney, Agent, or Firm*—James H. Barksdale, Jr.; John W. Henderson, Jr.

[57] ABSTRACT

A system for positioning final copy printed text, upon a first printing, at a specified location on a line in a format determined by input keying. The location can be a blank block on a form to be filled in. After initial setup and during any input or output operation, a final copy printed text mode can be entered by an operator and stored. This will inhibit printing upon further keying until a carrier return is keyed following the text. The printer carrier is positioned through spacing, backspacing, tabbing, etc. relative to the left side of the block, and codes representative thereof are also stored. When the carrier is at the left side of the block, the keying of a variable space or character will define a tentative format and this location, and a variable space or character code will be stored. Then the text is keyed and stored. After the text has been keyed, the keying of spaces, backspaces, tabs, and/or variable spaces will result in codes representative thereof being stored and the final copy text format being finalized. When the carrier is located at the right side of the block, a carrier return is keyed and this location is defined by the storing of a segment end code. The carrier is then automatically returned to the position occupied at the time of keying the final copy printed text mode. Thereafter, the carrier is positioned at the beginning print point for the format determined by input keying, and the final copy text is printed.

10 Claims, 13 Drawing Figures

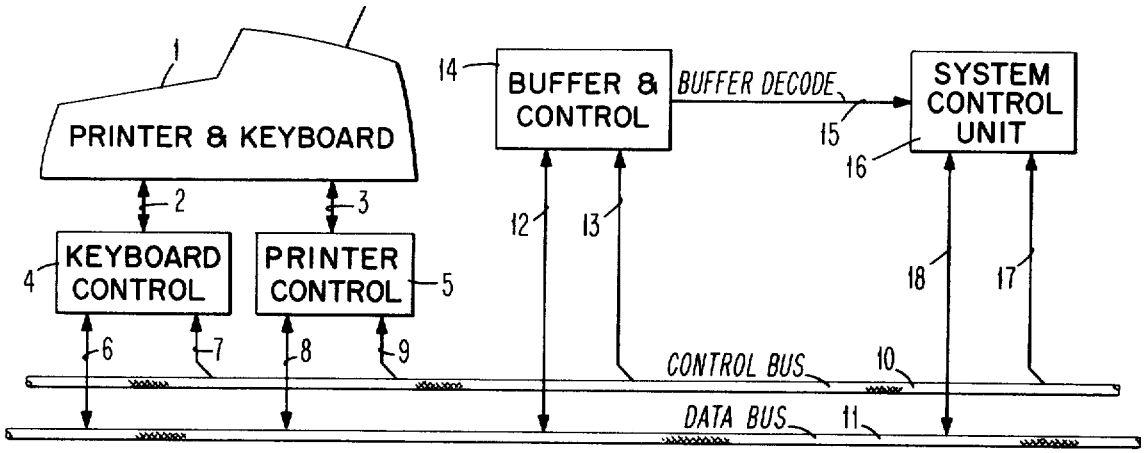
FIG. 1
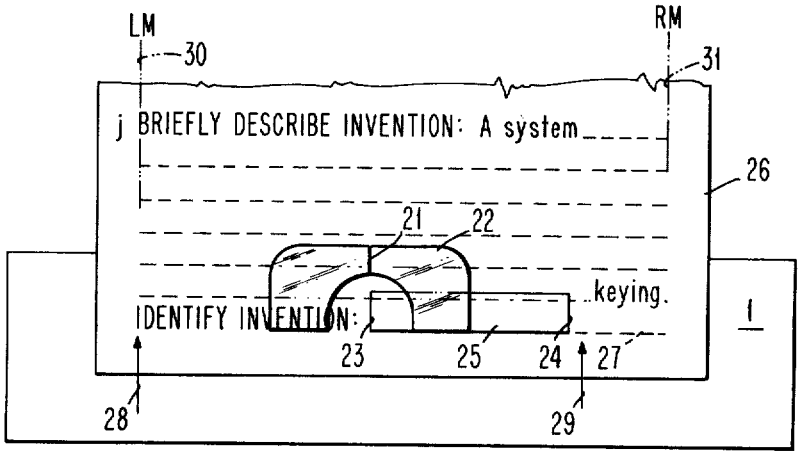
FIG. 2
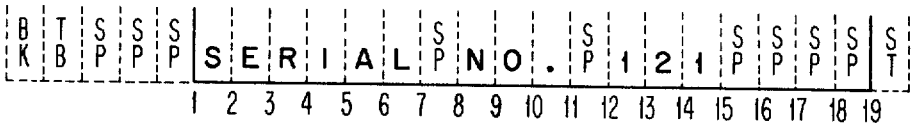
FIG. 3
FIG. 4
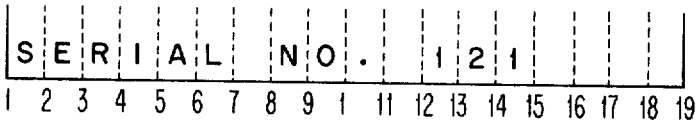

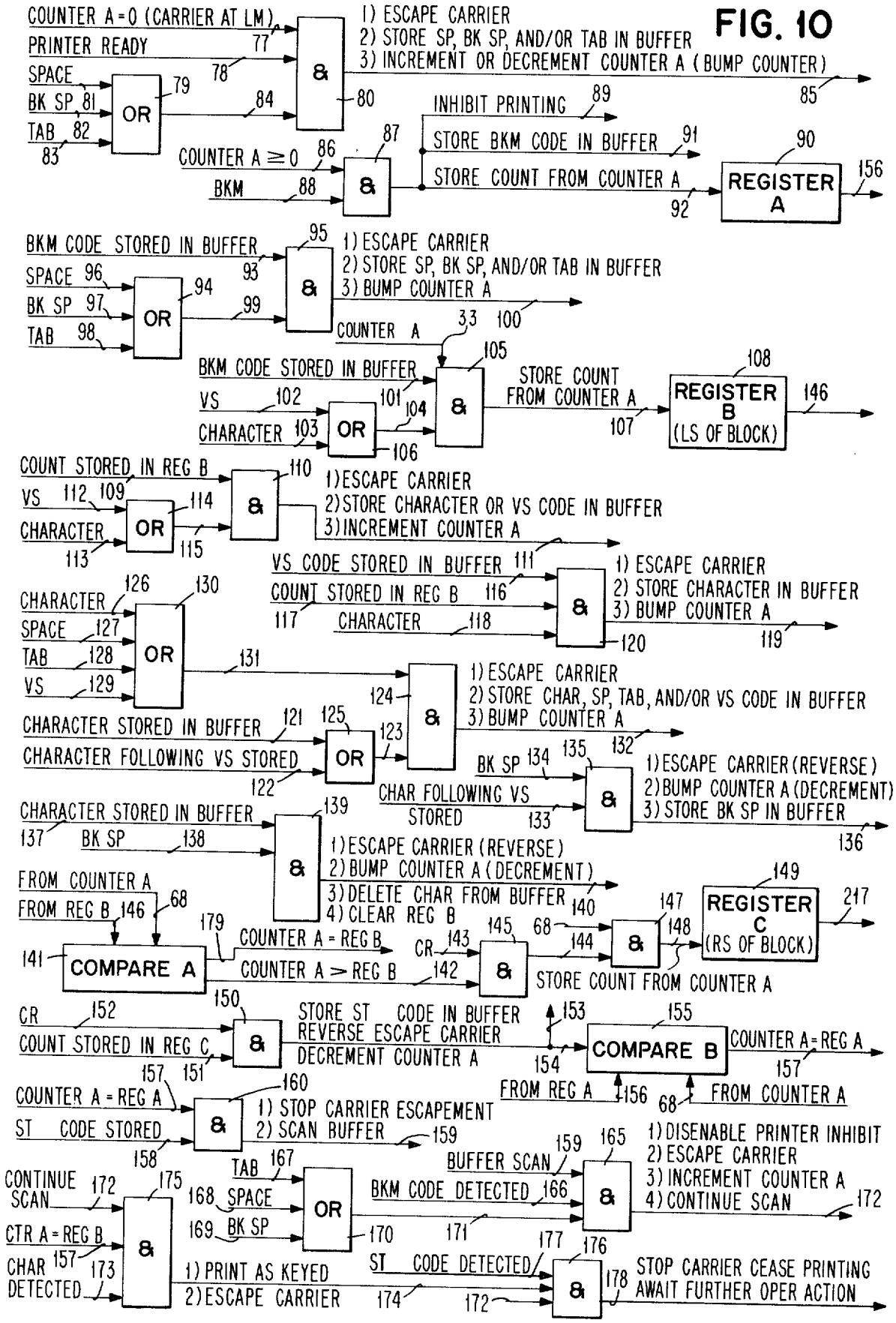
FIG. 10
COUNTER A=0 (CARRIER AT LM)
PRINTER READY
SPACE
BK SP
TAB
OR
&
1) ESCAPE CARRIER
2) STORE SP, BK SP, AND/OR TAB IN BUFFER
3) INCREMENT OR DECREMENT COUNTER A (BUMP COUNTER)
INHIBIT PRINTING
COUNTER A ≥ 0
BKM
STORE BKM CODE IN BUFFER
STORE COUNT FROM COUNTER A
REGISTER A
BKM CODE STORED IN BUFFER
1) ESCAPE CARRIER
2) STORE SP, BK SP, AND/OR TAB IN BUFFER
3) BUMP COUNTER A
COUNTER A
BKM CODE STORED IN BUFFER
VS
CHARACTER
STORE COUNT FROM COUNTER A
REGISTER B (LS OF BLOCK)
COUNT STORED IN REG B
VS
CHARACTER
1) ESCAPE CARRIER
2) STORE CHARACTER OR VS CODE IN BUFFER
3) INCREMENT COUNTER A
VS CODE STORED IN BUFFER
COUNT STORED IN REG B
CHARACTER
1) ESCAPE CARRIER
2) STORE CHARACTER IN BUFFER
3) BUMP COUNTER A
CHARACTER
SPACE
TAB
VS
1) ESCAPE CARRIER
2) STORE CHAR, SP, TAB, AND/OR VS CODE IN BUFFER
3) BUMP COUNTER A
CHARACTER STORED IN BUFFER
CHARACTER FOLLOWING VS STORED
BK SP
CHAR FOLLOWING VS STORED
1) ESCAPE CARRIER (REVERSE)
2) BUMP COUNTER A (DECREMENT)
3) STORE BK SP IN BUFFER
CHARACTER STORED IN BUFFER
BK SP
1) ESCAPE CARRIER (REVERSE)
2) BUMP COUNTER A (DECREMENT)
3) DELETE CHAR FROM BUFFER
4) CLEAR REG B
FROM COUNTER A
FROM REG B
COMPARE A
COUNTER A = REG B
COUNTER A > REG B
CR
STORE COUNT FROM COUNTER A
REGISTER C (RS OF BLOCK)
CR
COUNT STORED IN REG C
STORE ST CODE IN BUFFER
REVERSE ESCAPE CARRIER
DECREMENT COUNTER A
COMPARE B
COUNTER A=REG A
FROM REG A
FROM COUNTER A
COUNTER A = REG A
ST CODE STORED
1) STOP CARRIER ESCAPEMENT
2) SCAN BUFFER
BUFFER SCAN
BKM CODE DETECTED
1) DISENABLE PRINTER INHIBIT
2) ESCAPE CARRIER
3) INCREMENT COUNTER A
4) CONTINUE SCAN
CONTINUE SCAN
CTR A = REG B
CHAR DETECTED
TAB
SPACE
BK SP
1) PRINT AS KEYED
2) ESCAPE CARRIER
ST CODE DETECTED
STOP CARRIER CEASE PRINTING
AWAIT FURTHER OPER ACTION

FORMAT CONTROL SYSTEM FOR POSITIONING FINAL COPY PRINTED TEXT

BACKGROUND OF THE INVENTION

1. Field of the Invention

This invention generally relates to producing final copy printed text, and more specifically to a system for positioning final copy printed text, upon a first printing, at a specified location on a line in a format determined by input keying. 2. Description of the Prior Art Representative of the closest known prior art are the IBM "Selectric" Composer, the IBM Magnetic Tape "Selectric" Composer, the IBM Magnetic Card "Executive" Typewriter, the IBM Mag Card II Typewriter, and IBM Technical Disclosure Bulletins Vol. 9, No. 11, April ,1967, pages 1575–1577; Vol. 12, No. 11, April 1970, page 1808; Vol. 12, No. 12, May 1970, pages 2262 and 2263; Vol. 12, No. 12, May 1970, pages 2254 and 2255; Vol. 13, No. 2, July 1970, page 405; Vol. 13, No. 8, January 1971, pages 2390 and 2391; Vol. 14, No. 5, October 1971, pages 1560 and 1561; Vol. 14, No. 8, January 1972, page 2437; Vol. 15, No. 12, May 1973, page 3856; and Vol. 16, No. 2, July 1973, pages 391-394. Considering "centering" on the IBM "Selectric" Composer, an operator has to determine the center point of the centered material and position the carrier at this point. Thereafter a sliding centering scale must be manipulated to line up the position of the carrier with the zero point on the centering scale. The next operator action is to depress the no-print key, and then key the text. Upon completion of keying the text, the location of a position indicator relative to the centering scale is noted. Thereafter, the carrier is backspaced to a corresponding location to the left of zero on the centering scale. That is, if upon conpleting the typing of text the position indicator is positioned at the 16 point on the centering scale, the carrier is backspaced to the 16 point to the left of zero on the scale. Then the no-print key is released and the material is keyed again with printing occurring during keying.

*Registered Trademarks, International Business Machines Corporation

With the IBM Magnetic Tape "Selectric" Composer (MT/SC), there are no means for recording on the tape through the composer printer and keyboard. The tape must be prepared on an IBM Magnetic Tape "Selectric" Typewriter (MT/ST) and coded for use on the MT/SC. Then a tape program will cause control of format during the reading of the codes recorded by the MT/ST on the tape for accomplishing such operations as flush left, flush right and center. In this case, tape manipulation and tape program selection are required.

The IBM Magnetic Card "Executive" Typewriter requires, for centering a heading, tabbing to the desired center point, recording a required backspace code, and keying the text making up the heading. The suggested operator procedure is to record a required backspace code for every two characters in the heading.

An operator using the IBM Mag Card II Typewriter must determine the center point for centered material. Then the carrier is positioned at the center point through tabbing, backspacing or spacing. With the carrier located at the center point of the material to be centered, a coded character is keyed for entering a center mode and this results in a no-print mode. The centered material or text is then keyed and this keying causes backspacing. Upon the keying of a carrier return, printout occurs, followed by a carrier return. The carrier has already been repositioned to the starting point of the centered material, at the time the carrier return is keyed, due to the backspacing which occurs during no-print.

The first IBM TDB mentioned above discloses a recording technique wherein control information is recorded along with the text. Basic information is stored separately and recalled on playout to control format. The second IBM TDB referred to is also applicable to a recording technique for later control of format on playout. The third publication requires a first-pass printing during which escapement values are calculated. The fourth publication relates to allotting the excess spaces to break codes which are the equivalent of expand spaces or variable spaces. The fifth publication deals with a readily adaptable keying sequence. The sixth IBM TDB relates to the storing of control codes along with text for later control of format. The seventh publication discloses a use of variable space codes in conjunction with the required setting of tabulation positions. The eighth publication deals with determining the right margin through keying a carrier return. The ninth TDB referred to above discloses the defining of desired tabulation positions, among a number of set positions, through keying. The tenth TDB also requires locating the centering point for centered material.

From the prior art cited above, it is appreciated that the control of format, upon a first printing, requires excessive effort on the part of the operator. This is particularly the case when proportional spacing and/or centering are involved. As pointed out in describing the above IBM systems, mental calculations in terms of keying and determining the center point and/or scale manipulation are required. In the publications, format control programs, first pass printings, center point determinations and tabulation settings are required for controlling a final copy format.

Summary of the Invention

A system is provided having a keyboard and printer, a buffer and control, and a system control unit. At any time during either an input or output operation, an operator can enter and cause to be stored a final copy printed text mode. Further printing will be inhibited until a carrier return is keyed and a segment end code is stored therefor. Thereafter, the carrier can be repositioned through position keying tabs, spaces, etc., and this information is stored. With the carrier positioned at the left side of a block to contain formatted printed text, this point is defined through keying and storage. The keying and storage of format, text, tabs, spaces, etc., followed by a carrier return will cause repositioning of the carrier to the position occupied at the time of the keying of the final copy printed text mode. Then the text will be printed out in the position and according to the format determined by input keying.

The left side of the block is defined on input keying by the keying and storage of a variable space or character. If a character, then a flush left format is defined. If a variable space then a tentative flush right or center format is defined. The keying and storage of a variable space following the text will finalize the defining of a center format for the text to be positioned between the point of the first variable space and the carrier return point. The absence of a variable space following the text will finalize the defining of a flush right format for the text to be positioned against the carrier return point.

After the text has been keyed, the keying and storage of tabs, spaces, backspaces, following a variable space will cause carrier escapement, but will not determine the format. Further, the keying of a variable space following text for a flush left format will not affect the format.

BRIEF DESCRIPTION OF THE DRAWING

FIG. 1 is an overall block diagram of a system illustrating a printer and keyboard, buffer and control, system control unit, and the interconnections therebetween;

FIG. 2 is an illustration of a form inserted into the printer and keyboard and having the carrier card holder positioned relative to a blank block to be filled in;

FIG. 3 illustrates a keying sequence for positioning printed text in a flush left format in the blank block in FIG. 2 when a final copy printed text mode is entered at the left margin;

FIG. 4 illustrates a final copy printout of the text keyed in accordance with the sequence illustrated in FIG. 3;

FIG. 9 illustrates the structure for setting up the system when power is turned on;

FIG. 10 illustrates the structure for handling a flush left format determined by input keying;

DESCRIPTION OF THE PREFERRED EMBODIMENT

Generalized System Description

Figure 5:
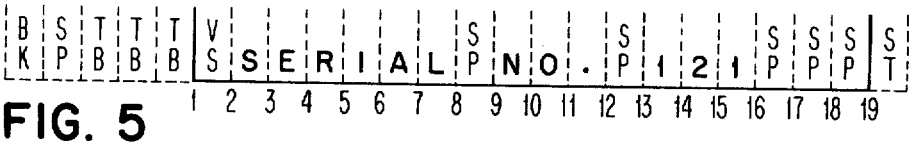
FIG. 5 illustrates a keying sequence for positioning printed text in a flush right format in the blank block in FIG. 2 when a final copy printed text mode is entered at the left margin.

For a more detailed description of the invention, reference is first made to FIG. 1 wherein there is shown an input/output typewriter 1 in communication with a buffer and control 14 through controls 4 and 5. The buffer making up buffer and control 14 is an electronic dynamic shift register and is controlled by a shift register control unit. The buffer and control 14 is fully described in U.S. Pat. Nos. 3,675,216 and 3,755,784.

The typewriter (printer and keyboard) 1 is in two-way communication with keyboard control unit 4 along line 2 and with printer control unit 5 along line 3. Keyboard control 4 and printer control 5 are also in two-way communication with data buss 11 along lines 6 and 8, respectively. Data buss 11 is in two-way communication with buffer and control 14 along line 12 and system control unit 16 along line 18. Control buss 10 is in two-way communication with keyboard control unit 4 along line 7, printer control unit 5 along line 9, buffer and control 14 along line 13, and system control unit 16 along line 17. System control unit 16 receives decoded data from buffer and control 14 along line 15.

The structure of system control unit 16 in terms of AND gates, counters, registers, comparators, etc., as well as the interconnections with the remainder of the system, is set out in other figures of the drawing.

Referring next to FIG. 2 there is illustrated typewriter 1 having a carrier card holder 22. Card holder 22 can be the same as that used with the IBM "Selectric" Typewriter. A scribed line 21 is used for operator viewing and determining the print point for the next character to be printed. As shown, line 21 is aligned with left side 23 of block 25 at line 27 on form 26. FIG. 2 will be further referred to hereinafter in conjunction with other drawing figures.

Final Copy Printed Text Mode Input and Output

FIG. 3 is a pictorial representation of the codes stored in the buffer (buffer and control 14 in FIG. 1) upon, and following the, entering of the final copy printed text or blind key mode (BK mode or BKM). For this illustration it is assumed that the BKM is entered with the carrier 860 (FIG. 1A) at the print position represented by arrow 28 (at the left margin 30) in FIG. 2. The keying of the BKM results in a BK code being stored in the buffer 14. Also, further printing is inhibited until a carrier return is keyed and a segment end (ST) code is stored. After the BK code has been stored, the carrier 860 is manually positioned at the left side 23 of block 25 (FIG. 2) through tabbing and spacing. As shown in FIG. 3, one tab code has been stored. Upon latter decode, the contents of a tab register (not shown) are sampled for escaping a number of units corresponding to the dialed in tab value. (Tab registers are well known to those of skill in the art, e.g., see IBM Technical Disclosure Bulletin, Vol. 13, No. 8, January 1971, pages 2141–2142). With the tab and spaces keyed and stored and with the carrier 860 positioned at the left side 23 of the block 25 (FIG. 2), the text "Serial No. 121" is keyed and stored. The numbers under the block (FIGS. 3–8) correspond to the print points.

Since a character has been keyed (print point 1) following position keying (tabs, spaces, backspaces, etc.), a flush left format is indicated and defined. With this being the case, if no editing and/or correction were contemplated, a carrier return could be keyed and a ST code instead of a space code stored at print point 15. This could possibly present a problem if a need arose later for additional text to be inserted. Therefore, suggested operator procedure is to position key to the right side 24 of block 25 (print point 19 in FIG. 3) and key a carrier return. The keying of a carrier return causes a ST code to be stored at print point 19, the carrier 860 to be returned to the left margin, the carrier 860 to escape to the left side of the block, the text to be printed as keyed, and the carrier to escape to print point 19 and stop; awaiting further operator action. The final copy printed text printout resulting from the above is illustrated in FIG. 4.

Figure 6:
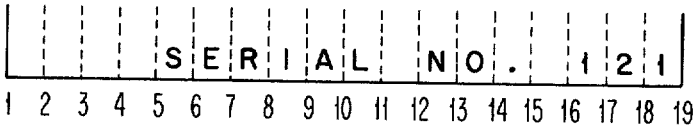
FIG. 6 illustrates a final copy printout of the text keyed in accordance with the sequence illustrated in FIG. 5.

FIG. 5 is another pictorial representation of the codes stored in the buffer 14 upon, and following the, entering of the BKM. For this representation, a different position keying operation is illustrated for positioning the carrier 860 at print point 1. One space and three tabs are keyed and stored. With the carrier 860 at print point 1, a variable space is keyed and a tentative flush right or center format is indicated. Then, the text is keyed, followed by position keying to the right side 24 of block 25 where a carrier return is keyed. Since only position keying follows the keying of text prior to the carrier return, a flush right format is finalized. Upon keying the carrier return, the carrier 860 is caused to return to the point where the BK mode was keyed, and then the carrier 860 is escaped to print point 5 (FIG. 6). Thereafter, the text is printed out as keyed, and the carrier 860 is stopped at the right side 24 of block 25 (FIG. 2); awaiting further operator action. For this example, the spaces following the text in FIG. 5 are used for positioning the carrier 860 at print point 5 in FIG. 6. Since a variable space is allocated a minimum space escapement, the spaces following the text are in effect repositioned or added to the variable space prior to the text. It is pointed out that no carrier escapement for a variable space could be readily provided for.

Figure 7:
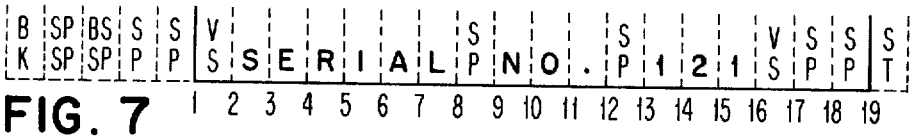
FIG. 7 illustrates a keying sequence for positioning printed text in a centered format in the blank block in FIG. 2 when a final copy printed text mode is entered at the left margin.
Figure 8:
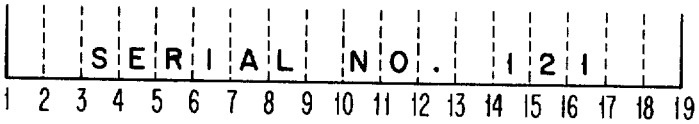
FIG. 8 illustrates a final copy printout of the text keyed in accordance with the sequence illustrated in FIG. 7.

FIG. 7 is yet another pictorial representation of the codes stored in the buffer 14 upon, and following the, entering of the final copy printed text mode. Here, another position keying operation is illustrated for positioning the carrier at print point 1. The two character positions in FIG. 7 following the BK code contain upper and lower codes. It is to be assumed that the upper codes in both positions are stored before either of the lower codes. That is, a BKM is keyed and a BK code is stored, a space is keyed and stored, a backspace is keyed and stored which repositions the carrier 860 and the operating point in memory to the point following the BK code, and four spaces are keyed and stored for positioning the carrier 860 at print point 1. The operating point can be an operation flag as fully described in, for example, U.S. Pat. No. 3,755,784. As illustrated, a variable space has been keyed and stored at print point 1; followed by text. The keying of the variable space code as described above defines a tentative format for flushing to the right or centering the text. Following the keying of text, another variable space code has been keyed at print point 16, finalizing the format for centering the text. Thereafter, position keying has taken place to position the carrier 860 at the right side of the block where a carrier return has been keyed. A ST code has been stored at print point 19. The keying of the carrier return causes the carrier to return to the point the BK mode was entered, the carrier to escape to print point 1, a calculation to take place for determining space escapement for centering the text, the carrier to escape for this space, the text to be printed out, and the carrier to escape to print point 19 and stop; awaiting further operator action. The printout of the text in a centered format is illustrated in FIG. 8.

From the above reference to FIGS. 3, 5, and 7, it is appreciated that position codes stored upon position keying may be any combination of tabs, spaces, etc. This applies to position keying both prior to the first character or variable space and following the last character or variable space.

System Set-Up on Power "On"

Figure 9:
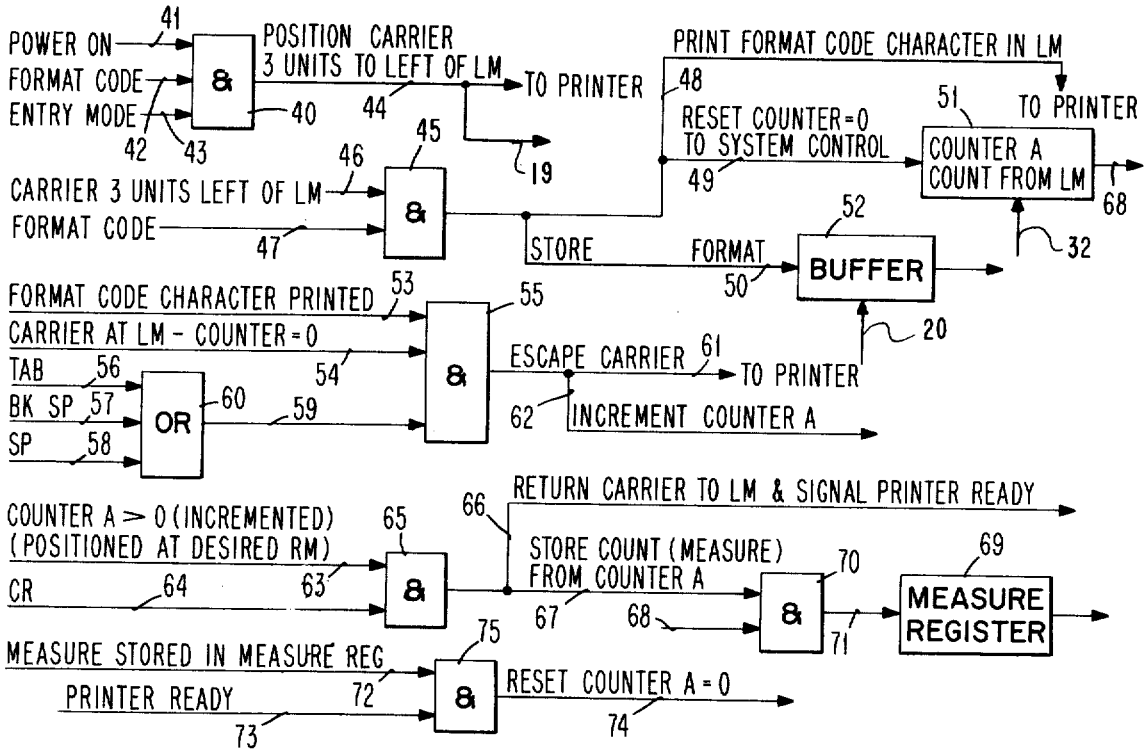

Referring to FIG. 9, there is shown structure for setting up the system when the power is turned on. References hereinafter to signal(s), inputs, outputs, etc. are to be taken as "up" conditions or positive logical levels. It is to be appreciated that when reference is made to signal(s), this can include, for example, a bit pattern representing a code or character. The power "on" sequence involves operation of a switch 850 on printer and keyboard 1 (FIG. 1A) causing a signal to be applied along line 41 to AND gate 40. Thereafter, the operator will key a format code such as a coded "*j*" for justification and a signal will be applied along line 42 to AND gate 40. The other input to AND gate 40 will be a signal applied along line 43 defining the mode (entry or playout). With these conditions being met, a signal is applied along line 44 for, upon decoding, causing the carrier 860 in printer and keyboard 1 to be positioned three units to the left of the left margin. The left and right margins represented by reference numerals 30 and 31 in FIG. 2 are defined on printer and keyboard 1 by mechanical margin stops 800 and 810. The output from AND gate 40 is also applied along line 19 for storing the entry mode code in buffer 52 along line 20. After the carrier has been positioned three units to the left of the left margin, a measure seek latch (not shown) is set by the keyed format code and a signal is applied along line 46 to AND gate 45. For purposes of clarity, numerous latches (resettable bistable flip-flops) and decodes utilized in the system have not been shown. Their use is completely obvious and they can be readily incorporated into the system by those skilled in the art, e.g., see U.S. Pat. No. 3,647,041. The other input to AND gate 45 is the format code along line 47. This code is the same as applied along line 42 to AND gate 40. The output from AND gate 45 is applied along lines 48, 49, and 50. The signal appearing on line 48 will, upon decode, cause the printing of the format code character, such as a "*j*" (FIG. 2), in the left margin. The signal applied along line 49 will cause the resetting of counter A, designated by reference numeral 51, to zero. The output along line 50 is the format code which is applied to buffer 52. Buffer 52 forms part of buffer and control 14 in FIG. 1. As is obvious, lines such as 48 and 49 throughout the following description will include decodes for decording the signals applied therealong; causing, for example, the printer to print the format code character and for resetting counter A.

After the format code character has been printed and a measure seek latch set, a signal is applied along line 53 to AND gate 55. The printing of the character *j* causes carrier escapement three units to the right. The left margin contact, a switch actuated by contact between the carrier 860 and the left margin stop 800, is then sensed and a signal is applied along line 54 to AND gate 55. It is to be pointed out that the character selected for printing in the left margin is of three units in width to compensate for the three unit escapement to the left of the left margin 30.

With the carrier positioned at the left margin 30 and counter A 51 set equal to zero, position keying tabs, backspaces or spaces will cause signals to be applied along lines 56, 57 or 58 to OR gate 60. The output of OR gate 60 is along line 59 to AND gate 55. The output of AND gate 55 is applied along line 61 to printer and keyboard 1 to cause carrier escapement for the tab, backspace or space keyed. The output of AND gate 55 is also applied along lines 62 and 32 for incrementing or decrementing (bumping) counter A for each tab, backspace or spaced keyed.

With the counter in counter A greater than zero and the carrier positioned at a point spaced from the left margin 30, i.e., at the desired right margin 31, the keying of a carrier return will satisfy the conditions for gating a signal from AND gate 65 along line 66. The indication that the count in counter A is greater than zero is applied along line 63. The carrier return signal is applied along line 64. The output of AND gate 65 applied along line 66 will cause the carrier 860 to return to the left margin 30 and result in a signal indicating that the printer is ready. The output of AND gate 65 is also applied along line 67 to AND gate 70. The other input to AND gate 70 is from counter A along line 68. The count in counter A is then gated along line 71 into measure register 69. With the measure stored in measure register 69, a signal indicative thereof is applied along line 72. The printer ready signal is applied along line 73 to AND gate 75. A signal is then applied along line 74 for causing the resetting of counter A to zero.

With the format and mode stored in buffer 52, and the measure stored in measure register 69, the system is now ready for further operator action.

Flush Left Format

Referring again to FIG. 2, it is first assumed that 1) an operator has finished filling in, upon input keying, form 26 through the word "keying", 2) the platen 820 in typewriter 1 has been indexed, and 3) the carrier 860 in typewriter 1 has been returned to the left margin 30 and positioned at arrow 28. With this being the case, reference is next made to FIG. 10. Counter A has been set equal (reset) to zero and a signal has been applied along line 77 to AND gate 80. Another input to AND gate 80 is the printer ready signal applied along line 78. With the print point being the left margin 30 and the invention identification block 25 (FIG. 2) to be filled in according to FIG. 4, the carrier must be repositioned. The operator can position the carrier at the left side 23 of the block 25 through position keying spaces, backspaces and/or tabs. Space, backspace and tab signals are applied along lines 81, 82 and 83, through OR gate 79, and along line 84 to AND gate 80. The output of AND gate 80 will be along line 85. This output will cause carrier escapement for the space, backspace and/or tab keyed, a space, backspace, and/or tab code to be stored in buffer 52 (FIG. 9), and the incrementing or decrementing of counter A (51 in FIG. 9).

Referring again specifically to FIG. 2, it is to be pointed out that the carrier 860 in typewriter 1 can be located at any point between the left and right margins 30 and 31 at the time the blind key mode is entered. If the carrier is at arrow 29, the operator can backspace to left side 23 of block 25.

Referring again to FIG. 10, with counter A greater than, or equal to, zero, a signal is applied along line 86 to AND gate 87. The keying of the BKM will result in a signal applied along line 88 to AND gate 87. The output of AND gate 87 will be applied along line 89 for inhibiting further printing, and along line 91 for storing the BK code in buffer 52. The output of AND gate 87 will also be applied along line 92 for storing the count corresponding to the present carrier position in register A, represented by reference numeral 90. After the BK code has been stored in buffer 52, a signal is applied along line 93 to AND gate 95. Signals for subsequently keyed spaces, backspaces and/or tabs are applied along lines 96, 97, and 98, respectively, to OR gate 94. The output of OR gate 94 is along line 99 to AND gate 95. The output from AND gate 95 is along line 100, causing carrier escapement for spaces, backspaces and/or tabs keyed. The output along line 100 also causes the storage of space, backspace and/or tab codes in buffer 52, and the bumping of counter A. Another indication that the BK code has been stored in the buffer 52 is a signal applied along line 101 to AND gate 105. The keying of a variable space or character will result in a signal applied along either lines 102 or 103 to OR gate 106. The output of OR gate 106 is applied to AND gate 105 on line 104. The output of counter A along line 68 (FIG. 9) is applied along line 33 to AND gate 105. The output from AND gate 105 will be the count in counter A applied along line 107. This count is stored in register B, designated by reference numeral 108. The count in counter A corresponds to the present position of the carrier relative to the left margin 30. The count stored in register B is the count from the left margin 30 to the left side 23 of block 25.

It is to be noted that position keying spaces, backspaces and/or tabs before or following the keying of the blind key mode will not define the left side of the block to contain printed text. The left side 23 of block 25 is defined by the keying of either a variable space or a character following the keying of the blind key mode. Therefore, the count stored in register B is also a definition of the left side 23 of block 25.

When the left side 23 of block 25 is defined and stored in register B, a signal is applied along line 109 to AND gate 110. The other input to AND gate 110 is either the variable space or character signal applied along lines 102 or 103. One of these signals will be applied along either lines 112 or 113 to OR gate 114. The output of OR gate 114 is applied along line 115 to AND gate 110. The output of AND gate 110 is applied along line 111 for causing (1) carrier escapement, (2) storage of a character or variable space code in the buffer 52, and (3) COUNTER A to be incremented.

If the left side 23 of block 25 is defined by a variable space, a signal is applied along line 116 to AND gate 120 when a variable space code has been stored in buffer 52. Another input to AND gate 120 is that the left side 23 of the block 25, or count representative thereof, has been stored in register B. This is applied along line 117. Yet another input to AND gate 120 is along line 118 for a character keyed following the variable space. The conditions are now met for gating an output from AND gate 120. This output is applied along line 119 for causing 1) carrier escapement for the character keyed, 2) storage of the character in the buffer, and counter A to be incremented.

If the signal applied along line 111 caused the storing of a character for defining the left side 23 of the block 25, a signal indicative thereof would be applied along line 121 to OR gate 125. The output of OR gate 125 is along line 123 to AND gate 124. The other condition for gating a signal through AND gate 124 is either a character on line 126, a space on line 127, a tab on line 128, or a variable space on line 129 to OR gate 130. The output of OR gate 130 is along line 131 to AND gate 124. The output of AND gate 124 is along line 132 for causing carrier escapement, storage of a character, space, tab, and/or variable space code in buffer 52, and the bumping of counter A. If a character, space or tab is applied along lines 126–128, it will form part of the text to be contained in block 25. If a variable space is applied along line 129, it will serve the same function as a space since a flush left format has been defined by the keying of a character, instead of a variable space, following the entering of the BK mode.

If a character code has been stored following a variable space code, a signal is applied along line 122, through OR gate 125, and along line 123 to AND gate 124. Again, the subsequent keying of characters, spaces, and/or tabs will form part of the text. Signals for those keyed characters, spaces, and tabs are applied along lines 126–128, respectively, to OR gate 130, and then along line 131 to AND gate 124. The keying of a variable space code following the input applied along line 122 will define a center format. The signal for the keyed variable space is applied along line 129, through OR gate 130, and along line 131 to AND gate 124. The subsequent keying of spaces and tabs will be for positioning the printer carrier at the right side 24 of block 25.

If a backspace is keyed following the storing of a character code following a variable space code, a signal is applied along line 134 to AND gate 135. A signal indicating that a character code has been stored following a variable space code is applied along line 133 to AND gate 135.

An output from AND gate 135 is applied along line 136 for causing reverse escapement of the carrier, and the decrementing of counter A. This output will also cause the storage of a backspace code in the buffer 52. It is to be appreciated that the character code following the variable space code could readily be deleted from the buffer 52.

If a character code has been stored in the buffer 52 for defining the left side 23 of the block 25 and a backspace is next keyed, signals are applied along lines 137 and 138, respectively, to AND gate 139. The output of AND gate 139 is along line 140 for causing reverse escapement of the carrier, the decrementing of counter A, deletion of the character from the buffer 52, and the clearing of register B. Register B must be cleared since the character defining the left side 23 of the block 25 has been removed from the buffer and the left side of the block must be redefined. The later keying of another character in this position will again define the left side 23 of the block 25. A similar operation would be performed if a variable space code had been stored for defining the left side of the block 25 and a backspace were next keyed.

From the time of defining the left side 23 of block 25, a continuous comparison is made in compare A, designated by reference numeral 141, between the contents of counter A and register B. When the contents of counter A are greater than register B, a signal is applied along line 142 to AND gate 145. This will indicate that the carrier is to the right of the left side 23 of block 25. The input into compare A from register B is along line 146, while the input from counter A into compare A is along line 68. When a carrier return is keyed defining the right side 24 of the block 25, a signal is applied along line 143 to AND gate 145. The output of AND gate 145 is along line 144 to AND gate 147. The other input to AND gate 147 is the count in counter A applied along line 68 from counter A. This count is then gated along line 148 into register C, designated by reference numeral 149. The count stored in register C is the count from the left margin 30 to the right side 24 of block 25. With the count from counter A stored in register C and the right side 24 of the block defined, a signal is applied along line 151 to AND gate 150. The other input to AND gate 150 is the carrier return along line 152. This signal was previously applied along line 143. A signal is then applied along line 153 for storing a segment end (ST) code (which is representative of the keyed carrier return), in the buffer 52. This output along line 153 also causes reverse escapement of the carrier and the decrementing of counter A. A signal is applied from AND gate 150 along line 154 to compare B, denoted by reference numeral 155, for comparing the contents of register A and counter A. The counts from counter A and register A are applied along lines 156 and 68, respectively. When the count in counter A is equal to the contents of register A, a signal is applied from compare B along line 157 to AND gate 160. The other input to AND gate 160 is a signal applied along line 158 after the ST code has been stored in the buffer 52. The output from AND gate 160 is applied along line 159 for causing the carrier to cease reverse escaping and a buffer scan operation to take place. The buffer scan operation is for scanning the contents of the buffer 52 from the BK code through the ST code. The buffer scan signal applied along line 159 is applied to AND gate 165. Another input to AND gate 165 is along line 166 when the BK code is detected. The other input to AND gate 165 is a tab, space and/or backspace code detected during scanning. Signals indicative thereof are applied along lines 167, 168 and 169, respectively, to OR gate 170. The output of OR gate 170 is applied along line 171. The output from AND gate 165 is applied along line 172 for disenabling the printer inhibit, escaping the carrier, incrementing counter A, and continuing the scanning operation.

As is obvious from the above, although only one line is shown carrying a number of signals for performing a number of operations, a number of lines are actually used. Only one line is shown for purposes of clarity.

The continue scan signal applied along line 172 is applied to AND gate 175. The counter A equal register B signal is applied along line 157 to AND gate 175, When a character code is detected upon scan, a signal is applied along line 173 to AND gate 175. The conditions are now satisfied for gating a signal along line 174 for causing the printing of text as keyed. This will include the characters and interword spaces keyed. The signal applied along line 174 is also applied to AND gate 176. Another input to AND gate 176 is the signal applied along line 172. The remaining input to AND gate 176 is along line 177 when the ST code is detected. The output from AND gate 176 is along line 178 for causing the carrier to cease escaping. The system will now await further operator action.

From the above, the final printed output is in a flush left format. This was determined by a character being keyed following the keying of the blind key mode.

Tentative Flush Right and Center Format

Figure 11:
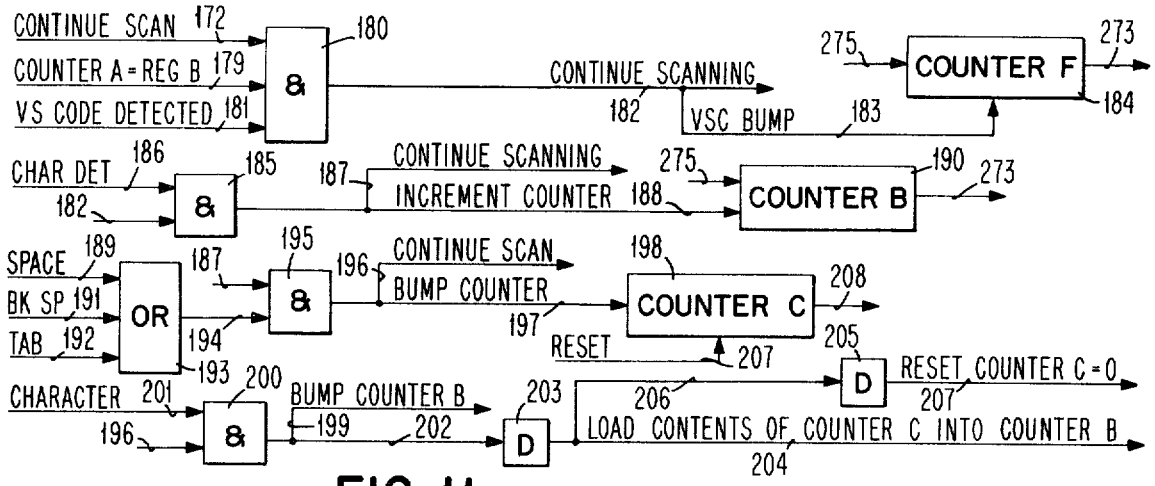
FIG. 11 illustrates the structure for handling tentative flush right and centered formats determined by input keying.

Referring next to FIG. 11, there is illustrated the case upon scan of detection of a variable space which has been keyed and stored for defining the left side 23 of the block 25. When the left side 23 of block 25 is defined by the keying of a variable space, a tentative flush right or center format is also defined. The continue scan signal is applied along line 172 to AND gate 180. Another input to AND gate 180 is the counter A equal register B signal along line 179. The remaining input to AND gate 180 is a signal along line 181 when a variable space code is detected following the BK code. The output from AND gate 180 is applied along line 182 for causing the scan operation to continue. The output from AND gate 180 is also applied along line 183 for causing the bumping or incrementing of counter F for the variable space code. Counter F is designated by reference numeral 184, and will be incremented a value equal to a minimum space. As scanning continues and characters are detected, signals are applied along lines 182 and 186, respectively, to AND gate 185. The output of AND gate 185 is along line 187 for continuing scanning, and along line 188 for incrementing counter B, denoted by reference numeral 190. The continue scan signal applied along line 187 is applied to AND gate 195. The detection of spaces, backspaces and/or tabs results in signals applied along lines 189, 191, and/or 192, respectively. These signals are applied to OR gate 193 and along line 194 to AND gate 195. The output from AND gate 195 is along line 196 for continuing the scanning operation and along line 197 for incrementing counter C. Counter C is designated by reference numeral 198. As scanning continues and character codes are detected, signals are applied along lines 196 and 201, respectively, to AND gate 200. The output from AND gate 200 is applied along line 199 for incrementing counter B for each character detected. Also, a signal is applied along line 202 to one bit delay 203. The output from delay 203 is along line 204 for adding the contents of counter C to the contents of counter B through the use of a full adder 198A (or other suitable means) along lines 204B and 204C. Counter B will now contain a count equal to the count of the printed text including interword spacing. That is, the count in Counter B will be for the first character to be contained in the block 25 through the last character to be contained in the block 25. Counter B will have the count in counter C added thereto only when a character follows a positioning code such as a space, backspace, etc. A signal is also applied along line 206 to one bit delay 205 for causing the resetting of counter C to zero along line 207.

Flush Right Format

Figure 12:
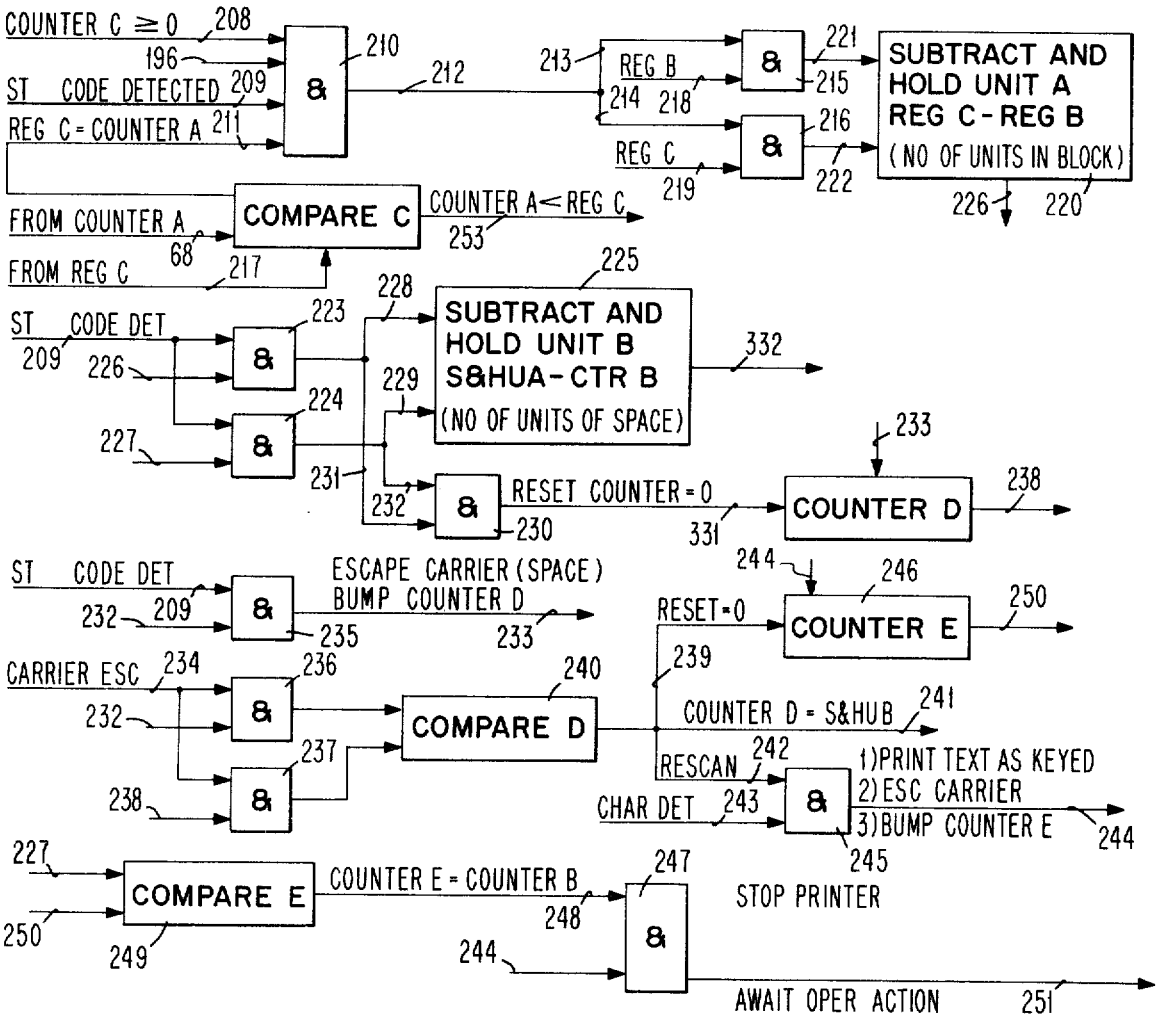
FIG. 12 illustrates the structure for handling a flush right format which has been finalized by input keying.

Referring next to FIG. 12, if the contents of counter C are equal to, or greater than, zero, a signal will be applied along line 208 to AND gate 210. Another input to AND gate 210 is a scan signal along line 196. When a ST code is detected during scan, a signal will be applied along line 209. The remaining input to AND gate 210 is a signal applied along line 211 when the contents of register C equal the count in counter A. Then a signal is output from AND gate 210 and applied along line 212 to lines 213 and 214. The inputs along lines 213 and 214 are applied to AND gates 215 and 216, respectively. The input to AND gate 210 along line 211 is received from compare C which compares the count in counter A along line 68 with the contents of register C along line 217. The other inputs to AND gates 215 and 216 are from register B along line 218 and register C along line 219. The contents of register B and register C are then gated along lines 221 and 222, respectively, to subtract and hold unit A, designated by reference numeral 220. Subtract and hold unit A will contain the number of units in block 25. The input 209 to AND gate 210 is also applied to AND gates 223 and 224. The other inputs to AND gates 223 and 224 are along line 226 from subtract and hold unit A, and counter B along line 227, respectively. The outputs of AND gates 223 and 224 are applied along lines 228 and 229 to subtract and hold unit B, designated by reference numeral 225. Subtract and hold unit B will contain the number of spaces preceding and following the text. These outputs are also applied along lines 231 and 232 to AND gate 230 for resetting counter D equal to zero. The output of AND gate 230 is along line 331. The output of subtract and hold unit B is applied along line 332 to AND gate 235. The other input to AND gate 235 is along line 209 upon detection of the ST code during scan. The output of AND gate 235 is along line 233 for causing carrier escapement, i.e., spacing the carrier, and for bumping counter D. With the carrier escaping inputs are applied along line 234 to AND gates 236 and 237. The output from subtract and hold unit B is applied to AND gate 236 along line 332, and the count in counter D is applied to AND gate 237 along line 238. The outputs from AND gates 236 and 237 are applied to compare D, designated by reference numeral 240. The output of compare D, when counter D is equal to subtract and hold unit B, is applied along line 241. This output is also applied along line 242 to AND gate 245 and along line 239 to counter E, designated by reference numeral 246. The other input to AND gate 245 is along line 243 when a character is detected during scan. When a character is detected, an output is applied along line 244 for causing carrier escapement for the printing of the text as keyed, and incrementing counter E. The output of AND gate 245 along line 244 is also applied to AND gate 247. The other input to AND gate 247 is along line 248 from compare E, designated by reference numeral 249. The inputs to compare E are along line 227 from counter B and along line 250 from counter E. The output from compare E when the count in counter E is equal to the count in counter B is applied along line 248 to AND gate 247. The output from AND gate 247 is along line 251 for stopping the printer, and awaiting other operator action.

From the above, FIG. 12 illustrates the structure for handling a flush right format defined by the keying of a variable space, text, and carrier return.

Centered Format

Figure 13:
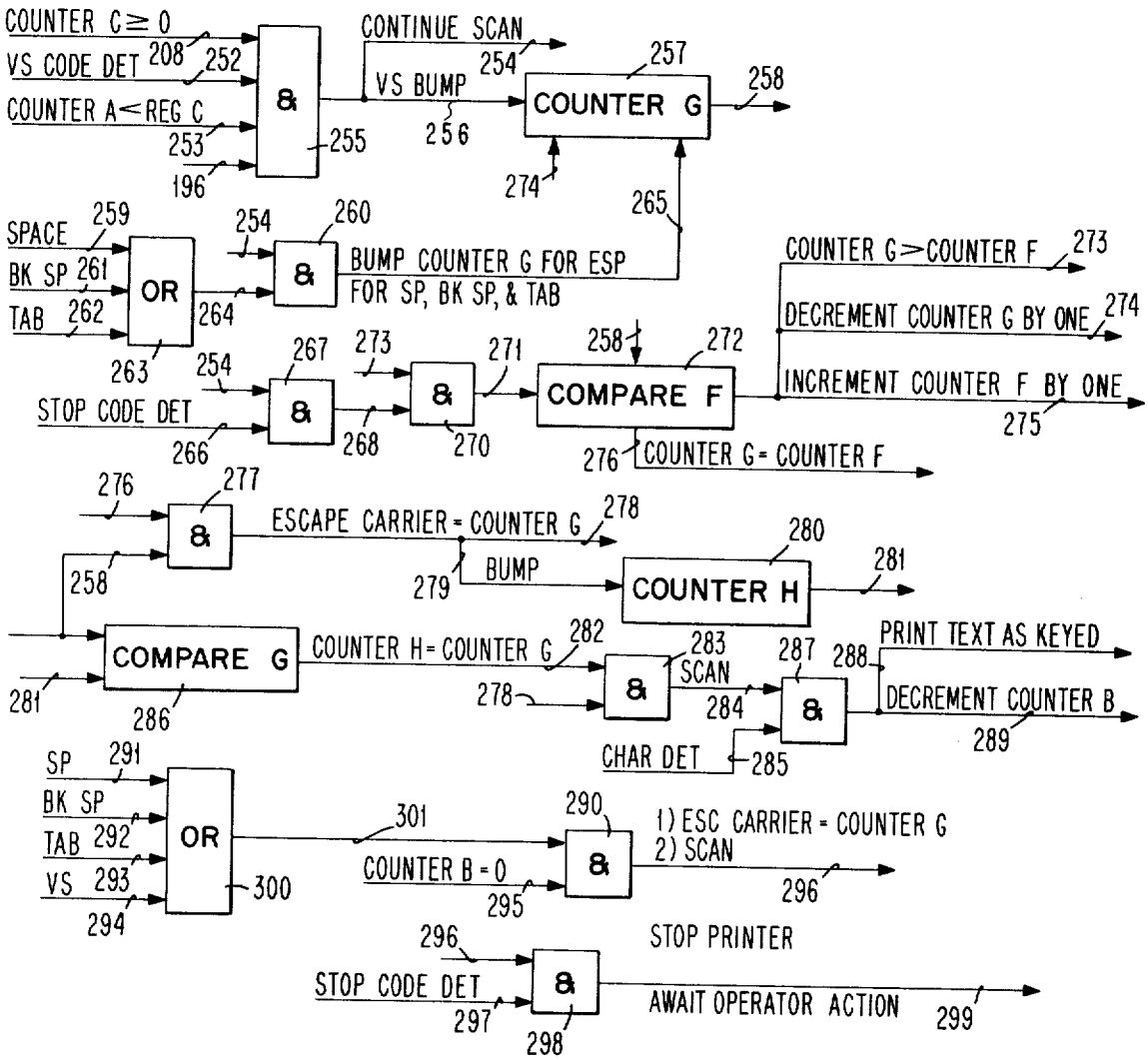
FIG. 13 illustrates the structure for handling a centered format which has been finalized by input keying.

In FIG. 13 there is illustrated the structure for handling a centered format defined by a variable space, text, and another variable space code. When the count in counter C is equal to, or greater than, zero, a signal is applied along line 208 to AND gate 255. A continue scan signal is applied along line 196, and when a variable space code is detected during scan a signal is applied along line 252. The other input to AND gate 255 is from compare C along line 253 when the count in counter A is less than the contents of register C. The output from AND gate 255 is applied along line 256 for incrementing counter G for the variable space code detected. Counter G is designated by reference numeral 257. The output from AND gate 255 is also applied along line 254 for continuing the scanning operation. As scanning continues, the continue scan signal applied along line 254 is applied to AND gate 260. The other inputs to AND gate 260 are for space, backspace, and/or tab codes detected upon scan. Signals representative thereof are first applied along lines 259, 261 and 262, respectively, to OR gate 263. The output from OR gate 263 is along line 264 to AND gate 260. The output from AND gate 260 is then applied along line 265 for incrementing counter G. The continue scan signal applied along line 254 from AND gate 255 is also applied to AND gate 267. When an ST code is detected, a signal is applied along line 266 to AND gate 267. The output from AND gate 267 is along line 268 to AND gate 270. The other input to AND gate 270 is applied along line 273 from counter F (FIG. 11). The contents of counter F are then gated along line 271 to compare F, designated by reference numeral 272. In compare F, a comparison is made between the count in counter G along line 258 and counter F along line 273. If the count in counter G is greater than the count in counter F, a signal is applied along lines 273A, 274 and 275. The signals applied along lines 274 and 275 will cause, respectively, the decrementing of counter G by one and the incrementing of counter F by one. This incrementing and decrementing continues until the output of compare F is along line 276, indicating that counter G is equal to counter F. With the count in counter G being equal to the count in counter F, the count in counter G is applied along line 258 to AND gate 277 and along line 278 for causing carrier escapement. Also, the output of AND gate 277 is applied along line 279 for incrementing counter H, designated by reference numeral 280. The output of AND gate 277 along line 278 is also applied to AND gate 283. The other input to AND gate 283 is along line 282 indicating that the count in counter H is equal to the count in counter G. This is from compare G, designated by reference numeral 286, having inputs along line 258 from counter G and line 281 from counter H. The output from AND gate 283 along line 284 is applied to AND gate 287. The other input to AND gate 287 is along line 285 upon detection of a character code during scan. The output of AND gate 287 is along line 288 for causing the printing of text as keyed. Also, the output of AND gate 287 is along line 289 for decrementing counter B as each character and interword space is escaped for during printing. Following the printing of the text, the buffer 52 is scanned for space, backspace, tab, and variable space codes. When these codes are detected, signals are applied along lines 291, 292, 293, and 294, respectively, to OR gate 300. The output from OR gate 300 is along line 301 to AND gate 290. The other input to AND gate 290 is along line 295 indicating that the count in counter B is equal to zero. The output of AND gate 290 is along line 296 for causing carrier escapement equal to the count in counter G and the scanning operation to continue. As scanning continues, a signal is applied along line 296 to AND gate 298. When a ST code is detected, a signal is applied along line 297. The output from AND gate 298 is along line 299 for causing the printer to stop and await other operation action.

In summary, a system is provided having a keyboard and printer, a buffer and control, and a system control unit. At any time during either an input or output operation, an operator can enter and cause to be stored a final copy printed text mode. Further printing will be inhibited until a carrier return is keyed and a segment end code is stored therefor. Thereafter, the carrier can be repositioned through position keying tabs, spaces, etc., and this information is stored. With the carrier positioned at the left side of a block to contain formatted printed text, this point is defined through keying and storage. The keying and storage of format, text, tabs, spaces, etc., followed by a carrier return will cause repositioning of the carrier to the position occupied at the time of the keying of the final copy printed text mode. Then the text will be printed out in the position and according to the format determined by input keying.

The left side of the block is defined on input keying by the keying and storage of a variable space or character. If a character, then a flush left format is defined. If a variable space, then a tentative flush right or center format is defined. The keying and storage of a variable space following the text will finalize the defining of a center format for the text to be positioned between the point of the first variable space and the carrier return point. The absence of a variable space following the text will finalize the defining of a flush right format for the text to be positioned against the carrier return point.

After the text has been keyed, the keying and storage of tabs, spaces, and backspaces, following a variable space will cause carrier escapement, but will not determine the format. Further, the keying of a variable space following text for a flush left format will not affect the flush left format.

While the invention has been particularly shown and described with reference to a particular embodiment, it will be understood by those skilled in the art that various changes in form and detail may be made without departing from the spirit and scope of the invention.

What is claimed is:

1. A system for printing final copy printed text at a specified location on a printing line upon a first printing comprising:

a. a printer;
b. a keyboard;
c. mode selection means in said keyboard for selecting the final copy printed text mode of operation;
d. print inhibit means responsive to said mode selection means for inhibiting outputting of data during input keying of data;
e. a buffer communicating with said keyboard for storing format control data and text data keyed on said keyboard; and
f. logic means operative in response to an end of line signal from said keyboard, said logic means including,
   1. means for scanning the data stored in said buffer,
   2. format control means operative in response to said scanning means for identifying the left side of said specified location, and
   3. print control means connected to said buffer and said printer and operative in response to said format control means for controlling said printer to print said text data according to said format control data.

2. A system according to claim 1 wherein said format control means further includes means for identifying a right side of said specified location.

3. A system according to claim 2 wherein said mode selection means further comprises means for storing, sequentially in said buffer;

1. said final copy printed text mode;
2. said left side of said specified location;
3. said format for said final copy printed text;
4. said final copy printed text;
5. any positioning codes; and
6. said right side of said specified location.

4. A system according to claim 3 further comprising means for causing printing to stop after said final copy printed text has been printed.

5. A system according to claim 4 further comprising means for storing escapement units for codes requiring escapement during said input keying.

6. A system according to claim 5 wherein said mode selection means for selecting said final copy printed text mode is operable during any input and output keying.

7. A system according to claim 2 wherein said format control means further includes means for centering said text data in said specified location.

8. A method of printing final copy printed text, upon a first printing, at a specified location on a line according to a format determined by input keying, said method comprising:

a. selecting the final copy printed text mode;

b. inhibiting outputting of data during input keying of data;

c. storing format control data and text data;

d. scanning the stored format control data and text data;

e. determining the left side of the specified printing location; and f. printing said final copy printed text in said specified location according to said format control data.

9. A method according to claim 8 including determining a right side of said specified location.

10. A method according to claim 9 including determining the center of said specified location.

* * * * *

UNITED STATES PATENT OFFICE

CERTIFICATE OF CORRECTION

Patent No. 3,968,868 Dated July 13, 1976

Inventor(s) John Charlie Greek, Jr., et al.

Figure 1A:
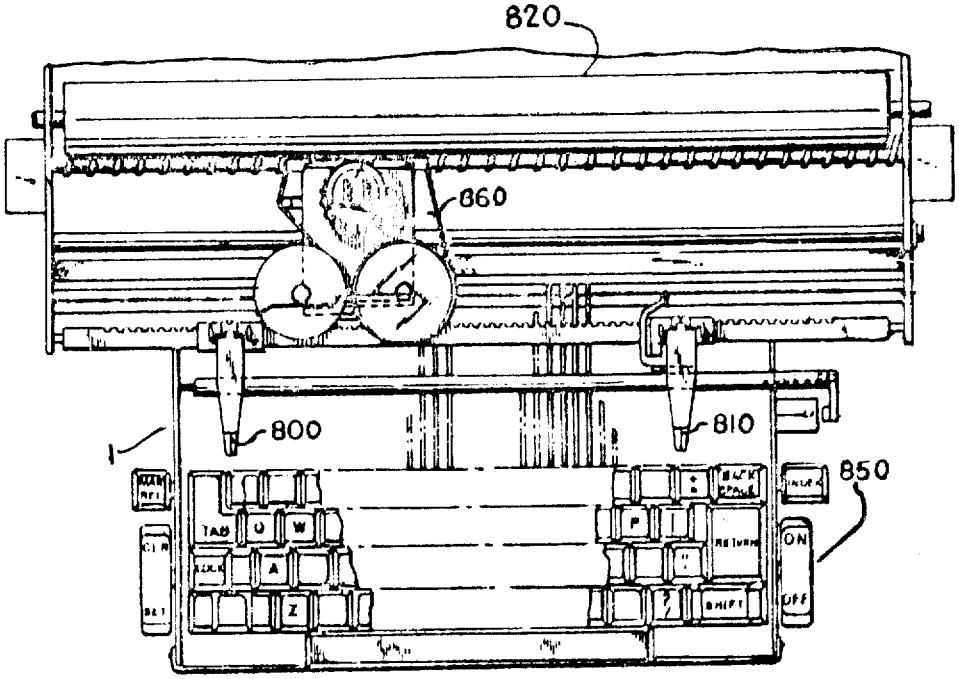
FIG. 1A is a plan view of the printer and keyboard of FIG. 1.
Figure 11:
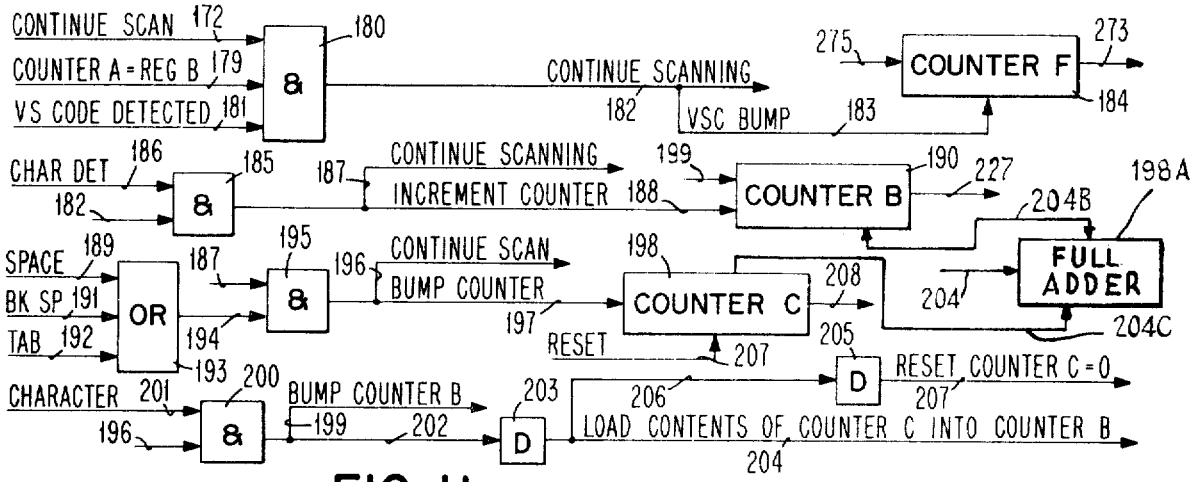
Figure 12:
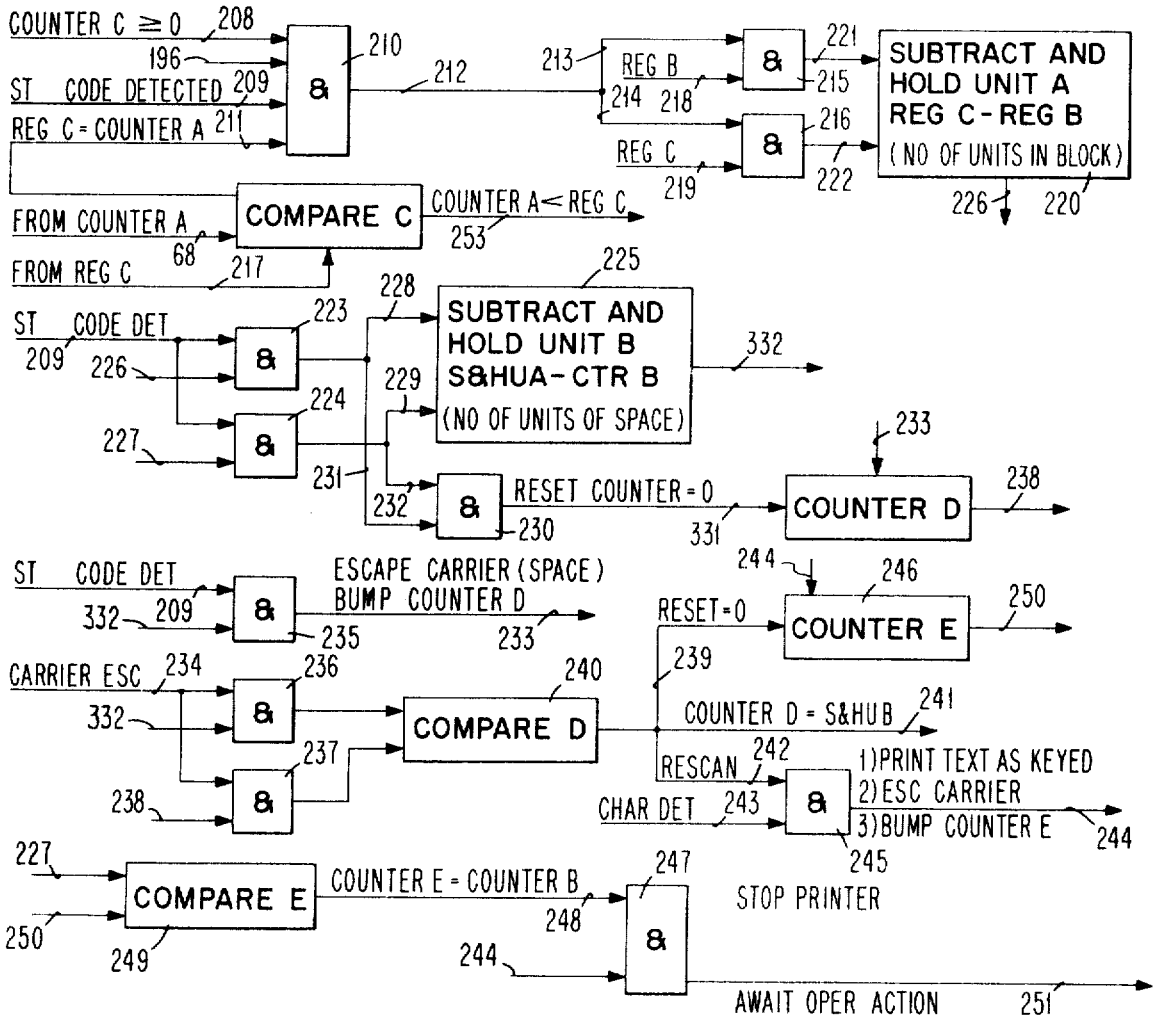
Figure 13:
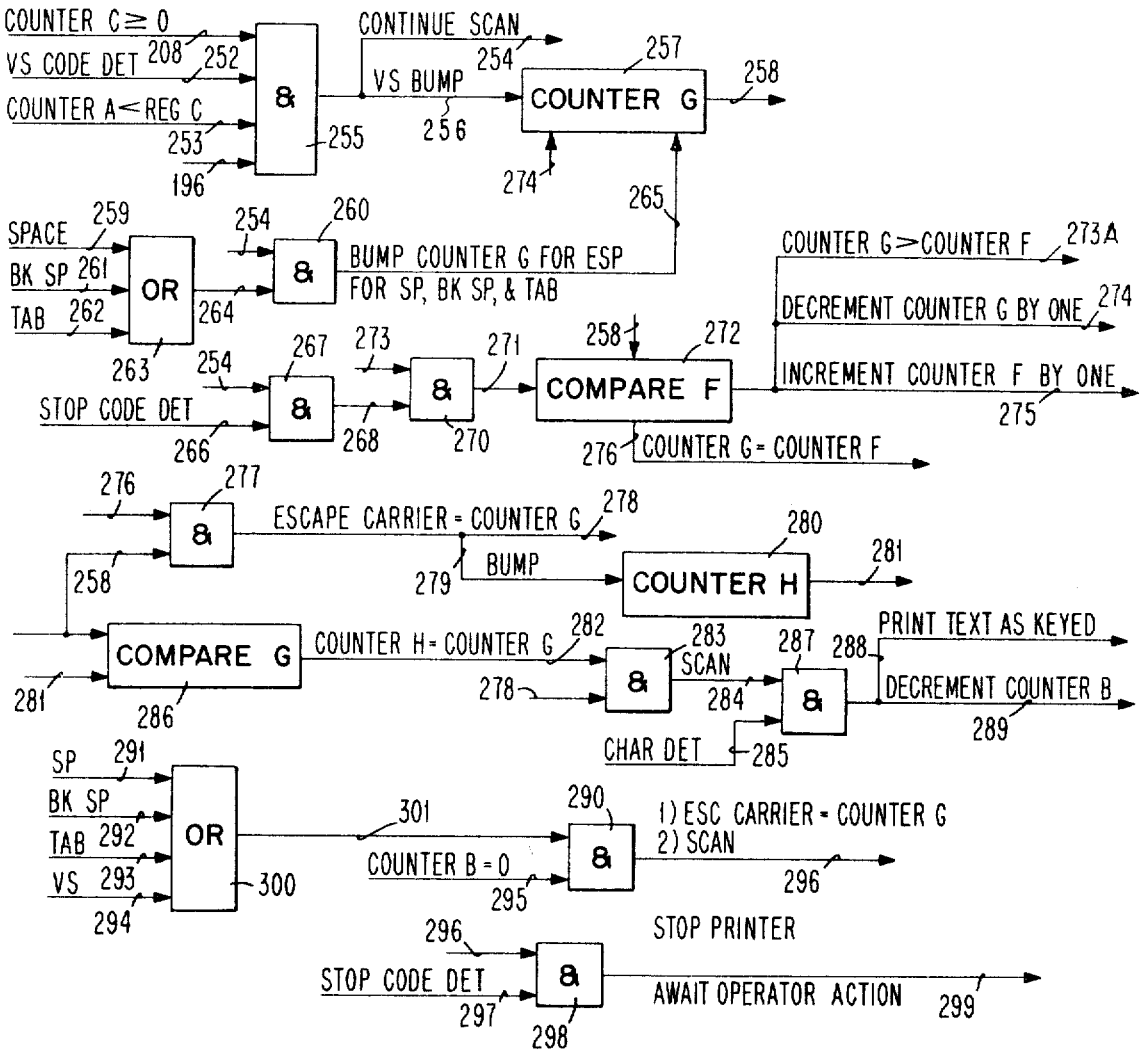

It is certified that error appears in the above-identified patent and that said Letters Patent are hereby corrected as shown below:

Insert FIG. 1A, as part of Letters Patent 3,968,868, as shown on the attached sheet. FIG. 11, 12 and 13, should appear as shown on the attached sheets.

Signed and Sealed this

Eighteenth Day of January 1977

[SEAL]

*Attest:*

RUTH C. MASON
*Attesting Officer*

C. MARSHALL DANN
*Commissioner of Patents and Trademarks*